United States Patent [19]

Colombo

[11] 4,397,204

[45] Aug. 9, 1983

[54] ROTARY SHEETERS TO SUIT THEM TO THE CUT OF WOOD VENEERS

[75] Inventor: Aristide Colombo, Monza, Italy

[73] Assignee: Colombo & Cremona S.A.S., Milan, Italy

[21] Appl. No.: 223,098

[22] Filed: Jan. 7, 1981

[30] Foreign Application Priority Data

Jan. 14, 1980 [IT] Italy ..... 19216 A/80

[51] Int. Cl.[3] ..... B27L 5/08

[52] U.S. Cl. ..... 83/289; 83/303; 83/346; 83/365; 83/371; 83/71

[58] Field of Search ..... 83/371, 303, 289, 343, 83/346, 364, 365, 369, 370, 327, 328, 71

[56] References Cited

U.S. PATENT DOCUMENTS

| | | | |
|---|---|---|---|
| 2,670,796 | 3/1954 | Orr | 83/303 |
| 3,120,861 | 2/1964 | Finlay et al. | 83/371 |
| 3,477,327 | 11/1969 | Aizawa | 83/371 |
| 4,008,639 | 2/1977 | Hasegawa | 83/371 |
| 4,009,628 | 3/1977 | Kato | 83/303 X |
| 4,085,638 | 4/1978 | Fifer | 83/71 |

*Primary Examiner*—Donald R. Schran
*Attorney, Agent, or Firm*—Michael J. Striker

[57] ABSTRACT

This invention refers to a multiple edge rotating blade type sheeter for cutting wood veneers, employing a main edged blade, designed to cut the progressing wood veneers in a minimum length equal to the arc between two successive cutting edges, and an auxiliary edged blade designed to remove a strip strictly containing a defective part of the wood veneer from each cut wood veneer, the main and auxiliary edged blades being opportunely spaced and their operations being controlled by means of an electronic apparatus.

7 Claims, 9 Drawing Figures

ROTARY SHEETERS TO SUIT THEM TO THE CUT OF WOOD VENEERS

BACKGROUND OF THE INVENTION

This invention relates to some improvements to rotary sheeters to suit them to the cut of wood veneers. Are known rotary sheeters, usually employed for cutting paper and cardboard sheets, that are provided with a straight blade having two or more parallel cutting edges, rotating around its longitudinal axis, and in which each cutting edge alternatively operates with the other through the rotation of the blade along an arc comprised between two successive cutting edges, that in case when a double edged blade is a 180° arc. Such blade cooperates with a holding up roller on which the sheets to be cut are advanced from a feeding conveyor belt and after the cut are moved away by means of a running conveyor belt, so that the minimum length of the cut sheets correspondes to the longitudinal development of the arc comprised between two successive cutting edges, because the peripheral speed of the blade is the same as that of the feeding conveyor belt and of the holding up roller. The above mentioned rotary sheeters are also equipped with means for automatic operation. To this purpose a device (scanner) is installed over the feeding conveyor belt, with the particular function to detect and signal possible defects present in the materials to an electronic apparatus storing the received data, returning them at the right moment for the cut and taking into account both the distance between the scanner and the blade and the length of the arc described by the rotating blade between two successive cuts.

In order to perform correct and timely cuts, the electronic apparatus is connected to an incremental pulse generator which exactly measures the length of the sheets running by and, at the right time, operates the engagement of a friction clutch, that rotates the blade of an angle comprised between two successive cutting edges, that is an angle of 180°. Such friction clutch is driven by a motor that synchronically controls the rotation both of the holding up and of the conveyor belt driving rollers.

In practice, however, the above mentioned rotary sheeters proved to be effective only for cutting sheet materials without imperfections, such as paper sheets and cardboard sheets; on the contrary they present considerable disadvantages in cutting wood veneers. This fact depends on the natural structure of this material. Indeed, due to the presence of knots, checks and other imperfections in the tree stock, the successive cuts of wood veneers must be irregularly spaced to exclude the imperfect sections.

When the well-known rotary sheeters are used, it is evident that the veneers can not be cut in sections having a length shorter than that of the arc described by the edged blade, so that the veneers, cut according to such length, must be cut again to exclude the sections containing imperfections. In this way the perfect sections are saved and an excessive waste of materials is avoided (the minimum length permitted by the double edged blades is comprised in the range of about 22–25 cm.). Of course, the further veneer section cuts constitute expensive and time-consuming operations that affect the productivity of the rotary sheeters which otherwise could operate at relatively high speed.

SUMMARY OF THE INVENTION

The main object of the invention is, therefore, to provide a rotary sheeter, that automatically executes the cuts of the wood veneers in the length permitted by the edged blade and also the successive cuts to eliminate the imperfect portions, so that the resulting veneer sections may have a length shorter than that permitted by the edged blade.

The rotary sheeter of the invention is characterized in that, in combination with the main edged blade an auxiliary edged blade is provided which is parallel to and opportunely spaced from said main edged blade, said auxiliary edged blade operating with a respective holding up roller, a respective friction clutch being provided to rotate said auxiliary edged blade to execute a cut intermediate the veneer section coming from said main edged blade, said friction clutch being controlled by a signal emitted by an electronic apparatus connected to the scanner that detects the imperfections of the veneers advancing towards the edged blades, and by an encoder, so that said electronic apparatus takes into consideration the spacements between said scanner and the main blade and the auxiliary one, so that the auxiliary blade is operated to cut from the passing veneer section a trasversal strip containing an imperfection. In a preferred embodiment of the invention a conveyor belt is interposed between the main and the auxiliary edged blade. In a further embodiment of the invention a discarding conveyor belt is provided immediately downstream the auxiliary edged blade, the supporting plane of said discarding conveyor belt being synchronically inclinable with the passing of the cut trasversal strips, to eliminate them and to feed the delivering conveyor belt with the perfect veneer sections only.

In a further embodiment of the invention every conveyor belt is formed by parallel continuous strips provided with suction holes running above suction means, so that the progressing veneer sections are impeded to slide and the registering of the cuts to be executed is maintained.

Further features and advantages of the invention will become evident from the following detailed description of possible embodiments with reference to the accompanying drawings wherein:

DETAILED DESCRIPTION OF THE PREFERRED EMBODIMENTS

Figure 1:
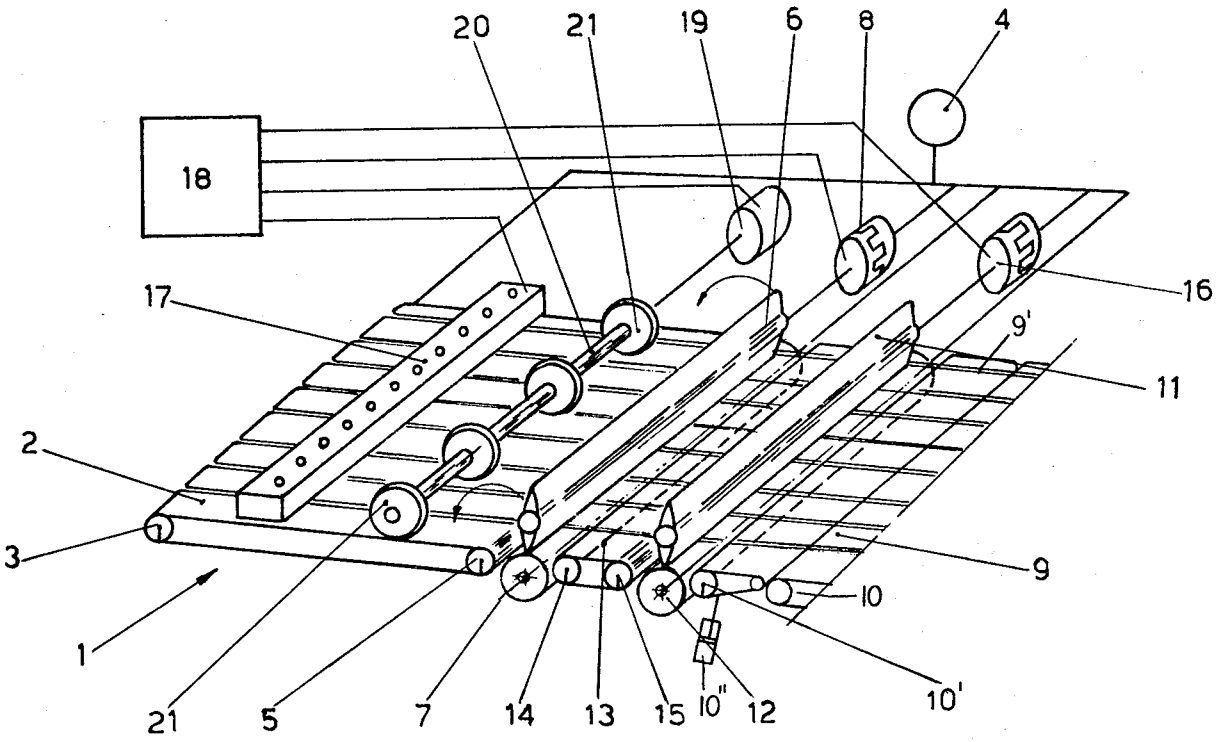
FIG. 1 is a diagrammatical perspective view of a rotary sheeter with double edged blades.

Referring firstly to FIG. 1, reference 1 generally indicates a rotary sheeter provided with a feeding conveyor belt 2, which is wrapped around a driving roller 3 operated by a motor 4 and around a driven roller 5 by means of which the wood veneers are fed to the cutting zone.

Just downstream the driven roller 5 a main double edged rotary blade 6 is provided, the axle of which is perpendicularly direct to the veneer advancing direction.

The double edged blade 6 cooperates with a holding up roller 7, so that when one of the cutting edges of the blade touches said holding up roller for the first time the moving wood veneer is cut. The holding up roller 7 is directly operated by the motor 4 through a known and conventional transmission system. The double edged blade 6 is rotated by the motor 4 through a friction clutch 8 that is operated at the right moment. In FIG. 1, the reference 9 indicates a delivering conveyor belt that wraps around a driving roller 10, driven by the motor 4, and around its respective driven roller, not shown, to deliver the cut sections of wood veneers.

Between a holding up roller 12 and the delivering conveyor belt 9 there is preferably a short conveyor belt 9' driven by a roller 10', the plane of which can be timely inclined downwards thanks to the action of a jack 10'' to eliminate the imperfect cut strips.

Upstream of the driving roller 10 of the conveyor belt 9, an auxiliary double edged rotary blade 11 is provided, similar to the blade 6 and cooperating with an underlying holding up roller 12, which cuts a further part of the sheet following a driving signal.

The auxiliary blade 11 is parallel at the double edged blade 6 and it is arranged to a predetermined distance from the latter. The auxiliary blade 11 is at the right time controlled, when it is necessary, through the engagement of its respective friction clutch 16 rotated by means of the motor 4. A third conveyor belt 13 is provided between the holding up rollers 7 and 12, having its run level as high as that of the conveyor belts 2 and 9.

Said conveyor belt 13 wraps around the driving roller 14 controlled by the motor 4 and around a driven roller 15 to move the cut veneer sections from the first blade 6 to the second blade 11. Above the first conveyor belt 2 there is a device 17 (scanner), which is parallel to the rotary blades 6 and 11 and suitable to the inspection of the sheet surface to detect holes or other imperfections. It sends the gathered data to an electronic apparatus 18 arranged in a inoperative area of the rotary sheeter. The electronic apparatus 18 can store the received data and at the right moment return them as signals engaging the friction clutches 8 and 18 to the respective rotary blades 6 and 11. The electronic apparatus 18 is also connected to a pulse incremental generator 19 (encoder), which is associated to a rotating shaft 20 on which disks 21 are mounted, to measure the length of the advancing wood veneers.

In these conditions, the electronic apparatus simultaneously takes into consideration:

- the presence of possible imperfections on the veneer surface;
- the moving veneer length;
- the distance between the scanner 17 and the blades 16 and 11, and
- the arc described by the rotary blade 6 and comprised between the successive edges.

Figure 2:
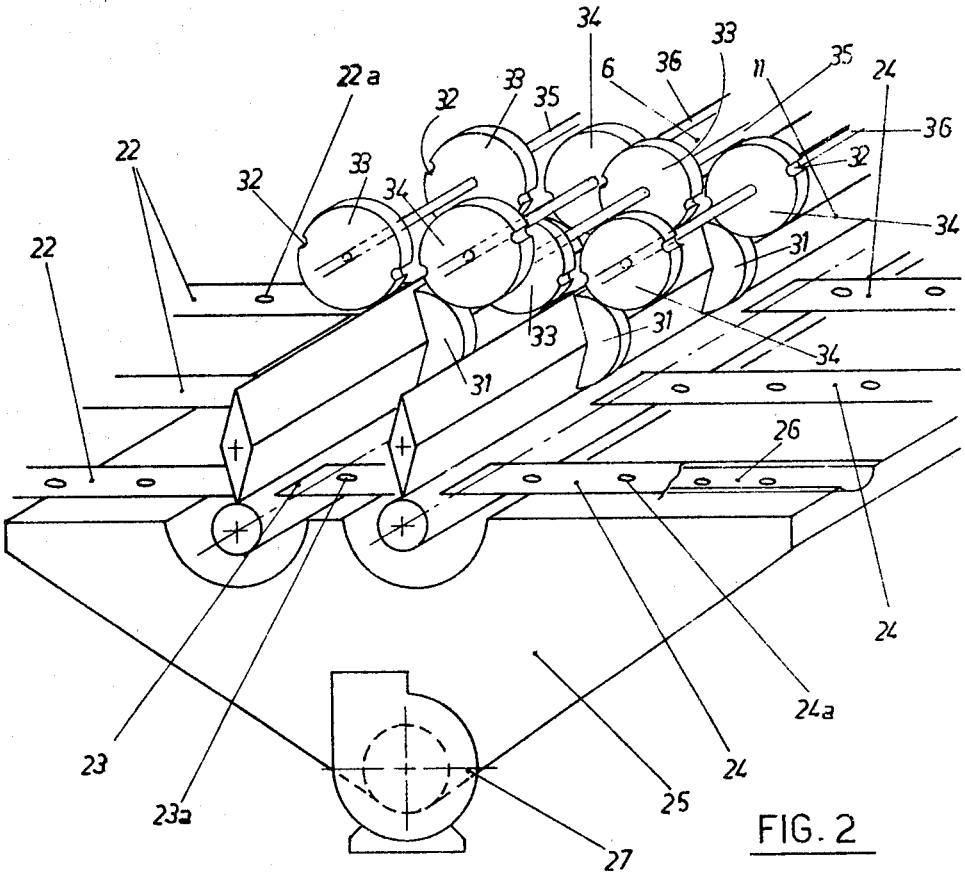
FIG. 2 is a diagrammatical perspective view of a second embodiment of a rotary sheeter.

In the particular embodiment of the invention shown in FIG. 2, the conveyor belts progressing the veneer sheets consist of respective pluralities of parallel strips 22, 23 and 24 spaced from each other. They are provided with holes longitudinally spaced and respectively indicated with references **22*a*, 23*a* and 24*a*. Just below the plane formed by the strips 22, 23 and 24 there is disposed the horizontal planar wall of a suction caisson 25 having the lateral walls tapered downwards for the connection to the suction part of a fan 27**.

The suction is transmitted to the holes **22*a*, 23*a* and 24*a* through holes arranged on the bottom of respective grooves, which are provided on said horizontal wall of the suction caisson 25 and longitudinally extend under the respective strips 22, 23 and 24**. This second embodiment of the invention is particularly suitable to assure the veneer sheets adhesion to the conveyors, especially when the latter have a reduced thickness or when the advancing speed is elevated. In fact the holes of the strips act as suckers on the veneer sheets, avoiding that the latter slide on the conveyors.

Even though the rotary sheeters represented in FIGS. 1 and 2 show different structures, they operate in similar way, as from the following statements.

Figure 3:
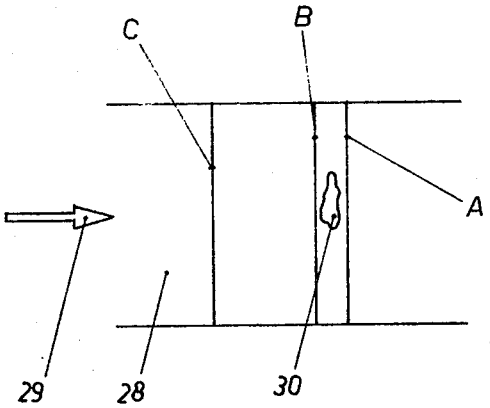
FIG. 3 shows the operative sequence of the cuts to be executed on a veneer sheet to delimit the defective portion to be eliminated.

Referring to the FIG. 3 a veneer sheet, indicated with the reference number 28, is progressed according to the arrow 29. On the veneer sheet 28 is present an imperfection, such as an irregular hole 30, so that the defective part of the material has to be discarded in the form of a strip as limited as possible.

In the same FIG. 3 the cuts executed by the main edged blade 6 are indicated with A and C, while that executed by the auxiliary blade 11 is indicated with B.

More precisely the cut A is firstly executed by the main blade 6 when a progressing veneer section has been detached, while the cut C is executed when the material is being cut and after a rotation of the main blade along a 180° angle. It is evident that, in absence of the blade 11, the spacement between the cuts A and C would be as long as the length of the 180° arc described by a cutting edge of the main blade. However, thanks to the presence of the auxiliary blade 11, timely operated by the electronic apparatus 18, an intermediate cut B is executed that detaches a strip containing the imperfection 30.

In the embodiments of FIGS. 1 and 2 the edged blades 6 and 11, because of the pressure exerted in the cutting step, are caused to bend and are not able to execute complete and uniform cuts on the passing veneer sheets.

Figure 4:
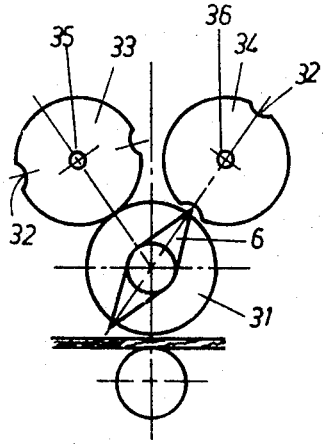
FIGS. 4 and 5 show the arrangement and the operation of shoulder and pressure rollers suitable to avoid the bending of the edged blades during the cutting phase.
Figure 6:
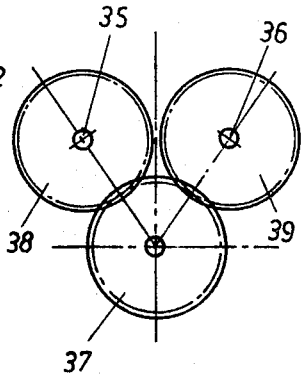
FIGS. 6 and 7 diagrammatically show the movement transmission to the pressure rollers and their arrangement along a blade.
Figure 7:
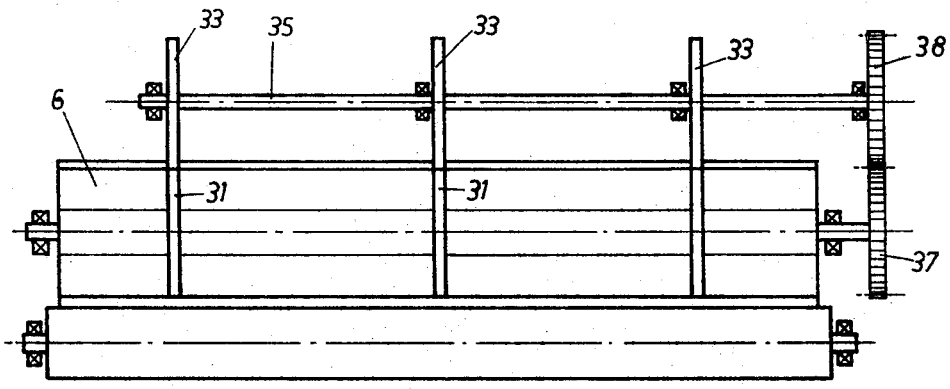

To avoid said disadvantage, as shown in FIGS. 2, 4 and 6, each edged blade is provided with a series of shoulder rollers 31, which are coaxal and distributed in a suitable number along the edged blade.

As may be noted, each shoulder roller 31 has a diameter shorter than the width of the respective blade, so that the cutting edges project beyond the circumference of the same rollers, to be able to perform their cutting action.

Each roller 31 is subject to the bias of one or two pressure rollers 33, 34 symmetrically arranged with respect to the vertical plane passing through the blade axis. In both cases the function of the pressure rollers is to transmit the blade a bias in the direction of the cut to avoid its bending.

The pressure rollers 33, 34 are provided with recesses 32 uniformly distributed along their circumferences and so located that they receive a respective blade cutting edge, when said cutting edge passes through the tangency zone, avoiding their interference with the pressure roller and the consequent breaking. The registering of the recesses 32, however, is such that they do not receive the respective blade cutting edge, at the moment wherein the blade has another cutting edge in the cutting position. In this way the pressure rollers are in condition to exert an effective bias exactly directed to counteract the blade tendency to bend.

As a consequence two pressure rollers 33 and 34 for each shoulder roller 31 are provided in the edged blades having an even number of cutting edges. Said pressure rollers 33 and 34 are symmetrically disposed with respect to the vertical plane passing through the blade axis, so that their respective biases compose a resultant disposed on said vertical plane and directed towards the actually operating cutting edge.

In the even number edged blade, in effect, exists another cutting edge diametrally opposed to each operating cutting edge, that would be inserted into the respective recess 32 when a sole pressure roller was used, but this condition is not technically advisable.

Two pressure rollers, therefore, are used in the embodiments of FIGS. 1 and 2, as better shown in FIGS. 4, 5, 6 and 7, because said embodiments provide double edged blades. FIGS. 4, 5, 6 and 7 show that the shoulder rollers 31 mounted on the edged blades 6 or 11, are coaxial to said blades and that the cutting edges of the respective blades project from the shoulder roller periphery.

Figure 5:
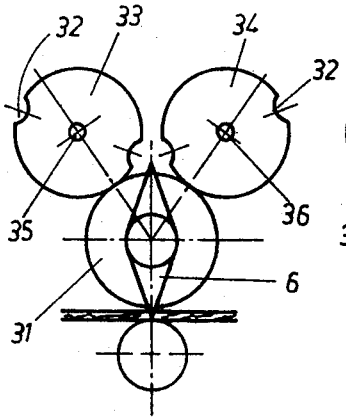
Figure 9:
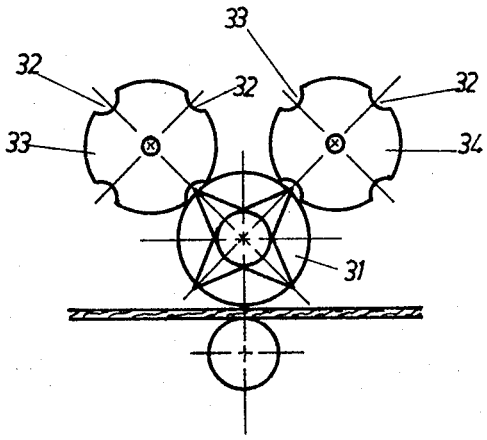
FIG. 9 shows the arrangement of shoulder and pressure rollers for a blade having an even number of cutting edges.

It may also be seen that pressure rollers 33 and 34 are provided for each roller 31, each one of them being located on a respective side of the vertical plane passing through the blade axis. The rollers 33 are mounted on a common shaft 35 on a same side and the rollers 34 are mounted on a common shaft 36 on the other side, while at a common end a gear transmission is provided, comprising a driving toothed wheel 37 mounted on the blade axis and that separately drives a toothed wheel 38 mounted on the shaft 35 and a toothed wheel 39 mounted on the shaft 36 with 1:1 ratio, to impart the same rotation speed to the rollers 31, 33 and 34. The same condition verifies in the case of FIG. 9 showing a four edged blade. Therefore two rollers 33 and 34, arranged as shown in FIGS. 4, 5 and 6, are coupled to every roller 31 mounted on the blade.

Figure 8:
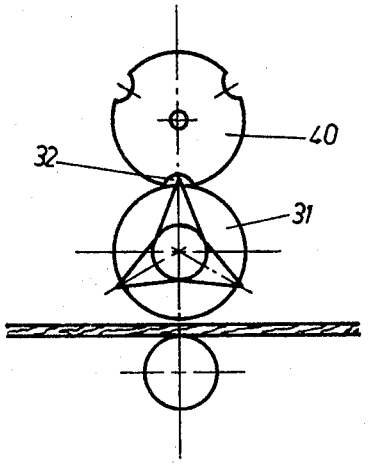
FIG. 8 shows the arrangement of a pressure roller for a blade having an odd number of cutting edges.

On the contrary, in the case of FIG. 8 referring to a three edged blade or to a blade having an odd number of cutting edges, a sole pressure roller 40 may be used for each blade shoulder roller, the axis of the pressure roller 40 being disposed on the vertical plane passing through the blade axis. This is possible because, when one of the cutting edges is vertically upwardly directed, no corresponding cutting edge diametrically opposed is in cutting position, so that said upwardly directed cutting edge may be inserted into a corresponding recess 32 of roller 40. On the contrary, in the angular position, where one of the cutting edges is in the cutting position, the rollers 31 and 40 meet along solid parts, so that they can exert a downwardly direct bias.

Of course many modifications may be applied to the rotary sheeter of the present invention by the skilled in the art without departing from its spirit, as pointed out in the following claims.

I claim:

1. A rotary sheeter for cutting wood veneer material in sections, comprising a first conveyor belt for advancing the material towards a cutting zone; a main multiple edge rotary blade and a first holding-up roller mounted at the cutting zone and cooperating with said main blade to cut the material in a minimum length depending on an arc between two successive cutting edges of said main blade; motor drive means; first friction clutch means connected between said drive means and said main blade to operate the latter; a scanning device for inspecting the advancing material surface to detect possible imperfections thereon and generating signals in accordance with those imperfections; an electronic device for receiving the signals from said scanning device and storing said signals; an incremental pulse generator connected to said electronic device and operative for measuring the length of the passing sheet materials and controlled by said electronic device to operate said first friction clutch means; a rotary auxiliary multiple edge blade extended parallel to said main blade and being spaced therefrom in the direction of advancing of the sheet material; an auxiliary holding-up roller cooperating with said auxiliary blade; second friction clutch means connected to said motor drive means and to said auxiliary blade and electrically connected to said electronic device to operate said auxiliary blade to execute a cut intermediate a section of the material advanced from said main blade, said second friction clutch means being controlled by a signal generated by said electronic device and said incremental pulse generator when said scanning device detects the imperfections on the advancing material, so that said electronic device takes into consideration the spacements between said scanning device, said main blade and said auxiliary blade and said auxiliary blade is operated to execute said intermediate cut on the passing section of said material to cut a traversal strip containing an imperfection from said section.

2. The rotary sheeter as defined in claim 1, further including a further conveyor belt positioned between said main blade and said auxiliary blade to move the material from said main blade to said auxiliary blade.

3. The rotary sheeter as defined in claim 2, further including a delivering conveyor belt and a discarding conveyor belt provided immediately downstream the auxiliary blade, the supporting plane of said discarding conveyor belt being synchronically inclinable with the passing of the cut transversal strips, to eliminate them and to feed the delivering conveyor belt with the perfect veneer sections only.

4. The rotary sheeter as defined in claim 3, wherein the conveyor belts are formed by parallel continuous strips provided with suction holes, the sheeter further including a suction caisson and a fan, the suction caisson being positioned below said strips and having lateral walls tapered downwards for the connection to a suction part of the fan, so that the veneer sheets are prevented from sliding along said continuous strips.

5. The rotary sheeter as defined in claim 1, wherein said main blade and said auxiliary blade are provided with coaxial shoulder rollers distributed along their axes and each having a diameter smaller than the width of said blades, so that the cutting edges of the respective blades project beyond their periphery, said main and auxiliary blades being further each provided with at least one pressure roller mounted in contact with respective shoulder rollers and rotating at the same rotation speed and being provided along its periphery with recesses circumferentially spaced from each after and being so registered to receive a respective cutting edge of the respective blade when said cutting edge passes through a tangency zone, said pressure rollers counteracting the tendency of the respective blade to bend in the moment of the cutting operation.

6. The rotary sheeter as defined in claim 5, said main blade and said auxiliary blade having an odd number of cutting edges, wherein a corresponding pressure roller is provided for each shoulder roller, the axis of said pressure roller being disposed on a vertical plane passing through the axis of the respective blade.

7. The rotary sheeter as defined in claim 5, said main blade and said auxiliary blade having an even number of cutting edges, wherein two pressure rollers are provided for each shoulder roller, said pressure rollers being symmetrically disposed with respect to a vertical plane passing through the axis of the respective blade and being operative for transmitting to the respective shoulder roller a resultant bias directed according to a cutting direction.

* * * * *